US005740940A

United States Patent [19]

Weiss

[11] Patent Number: 5,740,940

[45] Date of Patent: Apr. 21, 1998

[54] HINGED COVER FOR AN INSULATED BEVERAGE CONTAINER

[76] Inventor: Dave Weiss, 12230 87th St. North, Stillwater, Minn. 55082

[21] Appl. No.: 661,698

[22] Filed: Jun. 11, 1996

[51] Int. Cl.[6] ..... B65D 90/04

[52] U.S. Cl. ..... 220/412; 220/326; 220/335; 220/338; 220/739; 220/740; 220/903

[58] Field of Search ..... 220/411, 412, 220/903, 739, 740, 326, 335, 337, 338

[56] References Cited

U.S. PATENT DOCUMENTS

| | | | |
|---|---|---|---|
| D. 229,153 | 11/1973 | Moussette | 220/903 X |
| D. 229,156 | 11/1973 | Moussette | 220/903 X |
| D. 339,034 | 9/1993 | Walcott et al. . | |
| 4,720,023 | 1/1988 | Jeff | 220/412 |
| 4,735,333 | 4/1988 | Lay et al. | 220/739 |
| 4,872,577 | 10/1989 | Smith | 220/739 |
| 4,927,047 | 5/1990 | Stuber et al. | 220/903 X |
| 5,261,554 | 11/1993 | Forbes . | |
| 5,285,924 | 2/1994 | Morris . | |
| 5,305,900 | 4/1994 | Maguire et al. | 215/245 |
| 5,320,232 | 6/1994 | Maguire et al. | 215/245 |
| 5,328,069 | 7/1994 | Cohanfard . | |
| 5,421,472 | 6/1995 | Beckertgis . | |

*Primary Examiner*—Stephen Cronin
*Attorney, Agent, or Firm*—Terrance L. Siemens

[57] ABSTRACT

This invention relates generally to a portable beverage container holder and cover. More specifically, the invention is a floatable, insulated, beverage container holder, having an external tubular foam shell, and a two-piece device, comprising a dome-shaped cover portion and an annular collar portion. Hinged means, comprising of a rod connected to two ear shaped upwardly extended projections, is integrally formed with the annular collar, enabling the dome-shape cover to pivot between a forwardly closing position and a backwardly open position. The collar includes a recess in the rear of the hinge for receiving a locking projection correspondingly disposed at the back of the dome shaped cover. A frictional engagement between these corresponding parts retains the cover in an upright locked position, when it is pivoted backward. Similarly, the cover is adapted to snap into a watertight seal when it pivots forwardly into a closed position.

4 Claims, 3 Drawing Sheets

HINGED COVER FOR AN INSULATED BEVERAGE CONTAINER

BACKGROUND OF THE INVENTION

1. Field of the Invention

This invention generally relates to the field of portable beverage container holders and more particularly, to a floatable, insulated container holder, having a hinged dome-shaped cover, which pivots about an annular collar. In addition to being hinged, the cover is adapted to immovably snap into a locked state on the annular collar, when it is pivoted into both the open and closed positions. These locking positions are integral parts of the annular collar, and thus the collar and the cover are components comprising a two piece modular unit. The locking mechanisms provide the means for retaining the cover in a locked position, when said cover is either open or closed. The holder to which these components are attached, is a cylindrical shell having a tubular lining of foam for encapsulating a beverage container. The foam interior maintains beverages at a desired temperature for extended periods of time.

2. Description of the Prior Art

As will be seen, the simplicity and effectiveness of my invention is not rivaled in the prior art. The myriad of insulated containers designed for holding beverage containers such as cans, bottles, and jars have the main purpose of maintaining their beverage contents at a desired temperature for a reasonable length of time. In this respect, there have been larger insulated beverage containers such as coolers, ice chests, thermos flasks and the like, which are designed to hold larger quantities of ice or hot or cold liquids for over an extended period of time. Although these insulated receptacles have been the preferred form of beverage containers for hikers, campers, golfers boaters and similar outdoor enthusiasts, these foamed containers possess certain characteristic disadvantages and inconveniences that render them unsatisfactory.

For example, coolers and ice chests are cumbersome, large, and inconvenient for short excursionary trips. If outdoor enthusiasts were to transport one of these cumbersome containers, they would have to inconveniently disembark, in order to avail themselves of the contents of the beverage container. Many tubular versions of insulated beverage container holders preferred by cyclists have covers that can only be removed by employing the use of both hands, one hand holding the cover and the other holding the container proper—a feat many riders would not dare to execute while riding their bikes. An open soda can in an outdoor setting poses the danger of insects and bees entering the can which may create a potential danger for an unsuspecting drinker. Debris and dust in the atmosphere that may enter into an open beverage can present another health consideration. Furthermore, many drivers are accustomed to carrying open beverage can held between their legs whereby their body heat is imparted to the container, thus increasing the temperature of the liquid therein.

U.S. Pat. No. 5,261,554, issued on Nov. 16, 1993 to Forbes discloses a beverage container having an external shell, and a foam tube lining the interior of the shell, for holding beverage containers. The container is floatable and includes a top and bottom covers which are retained in position by means of projections that fit into slots. This insulated beverage container does not, however, include an integrally molded, recesses and projected mating members for retaining the cover in both open and closed positions.

U.S Pat. No. Des 339,034, issued Sep. 7, 1993 to Walcott et al. shows an insulated cover for beverage containers. The beverage container does not, however, include a hinged cover.

U.S. Pat. No. 5,328,069, issued Jul. 12, 1994, to Cohanfard, shows a beverage container having a substantially dome-shape cover, but the cover does not include a hinge by means of which the cover pivots forward or backward.

Other prior art disclosures are even more remote. U.S. Pat. No. 5,421,472, issued Jun. 6, 1995, to Beckertgis, shows an insect proof cover for beverage containers. The container includes a rotatable, tamper-evident cover having an opening with bars. The container does not include any insulation, however or a two-piece cover device.

U.S. Pat. No. 5,285,924 issued Feb. 15, 1994, to Morris, discloses a slidable, removable cover for a beverage container that is adapted to cover or expose the opening of a can using the same hand that holds the can. The cover neither provides insulation nor causes the can to float if it's inadvertently dropped in water.

In view of these characteristic disadvantages found in the prior art, it would be a significant advancement in the art to provide a floatable, insulated, beverage container having a hinged rotatable cover device, for hikers, bikers, drivers, boaters, and other outdoor enthusiasts, that is easily and safely transported, without spillage.

SUMMARY OF THE INVENTION

Briefly, the invention comprises an insulated beverage container holder, comprising an outer cylindrical shell and a rotatable cover device, for maintaining beverages at desired temperatures for long periods of time. The cover device includes an annular collar With a hinge, which enables a dome-shape lid to be pivoted forward or backward. When the cover is pivoted backward, i.e., the open position, a recess disposed on the annular collar of the two-piece cover device, provides a frictional locking engagement, thus maintaining the cover in an open position. A bulging projection of a recess situated on the annular collar, directly under the lift tab of the dome cover, provides a locking means for the lid when it is pivoted in the forward position, i.e., the closed position.

Accordingly, it is a principal object of the invention to provide a new and improved insulated beverage container cover and collar which overcomes the disadvantages of the prior art in a simple but effective manner.

It is a major object of this invention to provide an insulated beverage container holder having a two-piece cover lid device comprising an annular collar portion and a hinged cover portion which enables the cover to be pivoted into a closed as well as an open position.

It is another object of the invention to provide a dome-shaped lid having a projection on its rear portion, which frictionally engages a recess at the rear of an annular cover.

It is a still further object of the invention to provide an annular collar having a projected recess disposed at the front, for frictionally engaging the dome cover and retaining it in a closed position, resulting in an air and water tight seal.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 2:
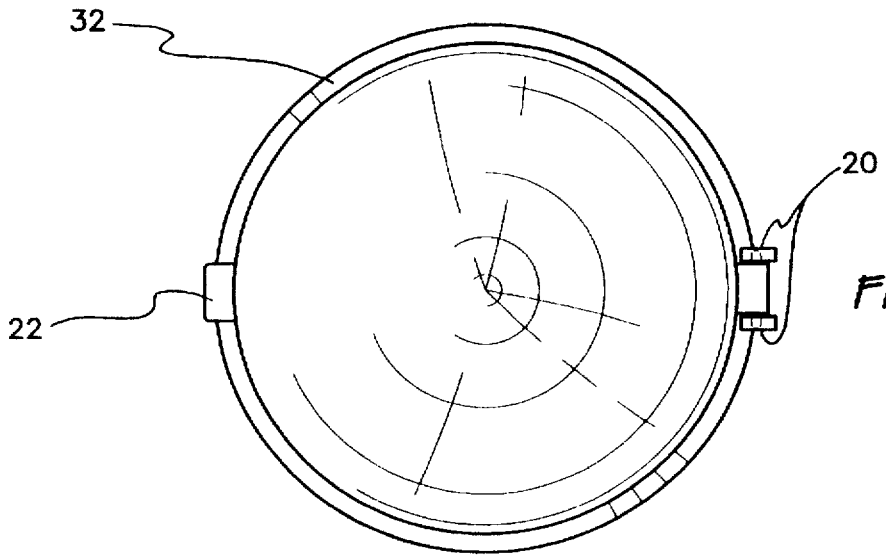
FIG. 2 is a top plan view of the annular collar showing the rear hinge and the front lift tab, located on opposite positions of the rim of the annular collar.
Figure 1:
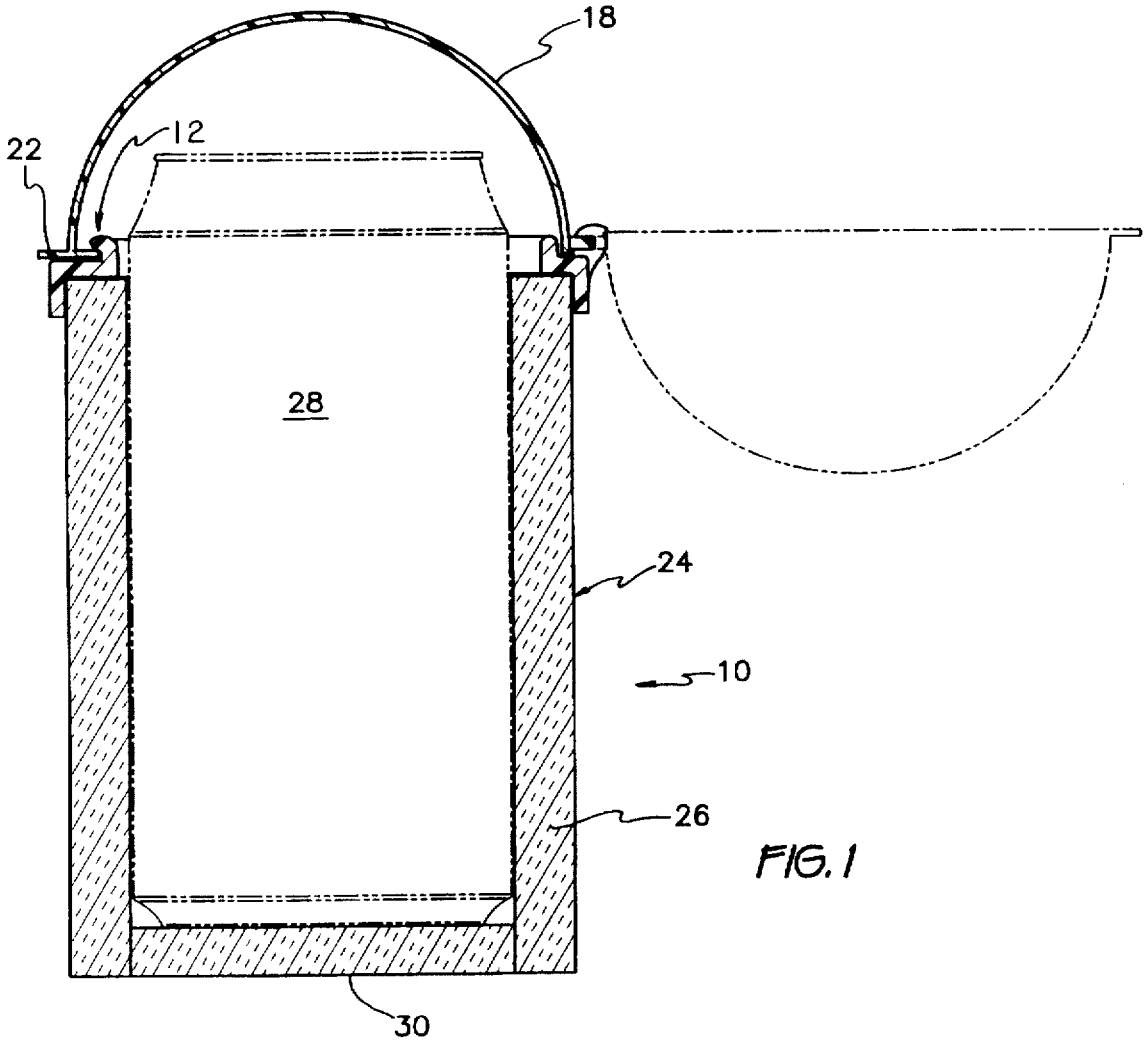
FIG. 1 is a front elevation view of the invention showing the cover in both the open and closed positions.

Referring initially to FIG. 1 of the drawings, the floatable, insulated, beverage container wrap of the present invention is generally illustrated by reference numeral 10. The cylindrical body of the beverage container wrap 10 consists of an external shell portion of tubular foam lining 24. The foam lining 24 may be constructed from styrofoam or like material that is impervious to water and has a specific gravity less than that of water. This physical property of the foam enables the beverage container 10 to float in water. It is understood by this inventor that those skilled in the art are aware of insulation materials such as polyethylene and polyurethane, among many others, which possess the above mentioned physical properties. These foam insulation materials that possess buoyant qualities are also easy to clean, and when molded in the appropriate thickness, they become waterproof. The seamless tubular foam 26 is adapted for holding cylindrical beverage containers such as shown in FIG. 1. While this cylindrical configuration may be ideal, it is by no means exhaustive of the various shapes that may be constructed to accommodate specific needs.

Figure 3:
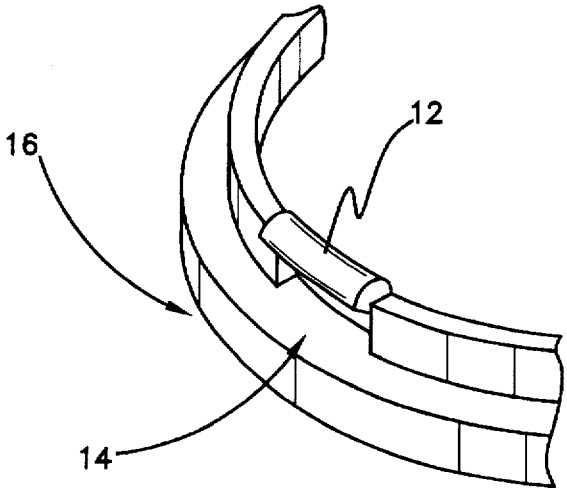
FIG. 3 is a perspective view of the integrally molded locking projection and recess disposed at the front of the annular collar.

The cylindrical shell 10 includes a sealed bottom end 30, molded to prevent jagged or cornered edges that may injure a user. The annular collar 16 shown in FIG. 3 is sized to provide a snug fit for the external circumference of the beverage container.

Figure 4:
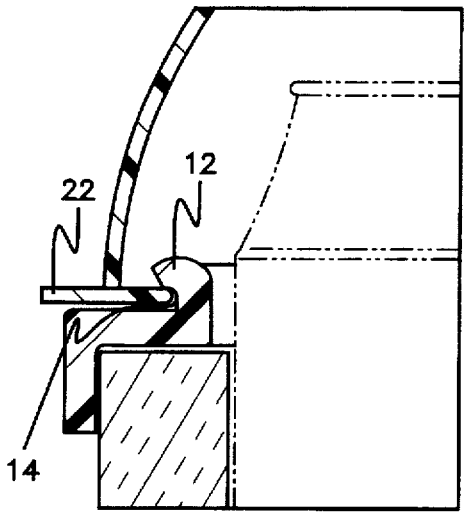
FIG. 4 is a perspective front view of the horizontal lift tab of the cover in a locking engagement with the projection of the recess on the annular collar.
Figure 5:
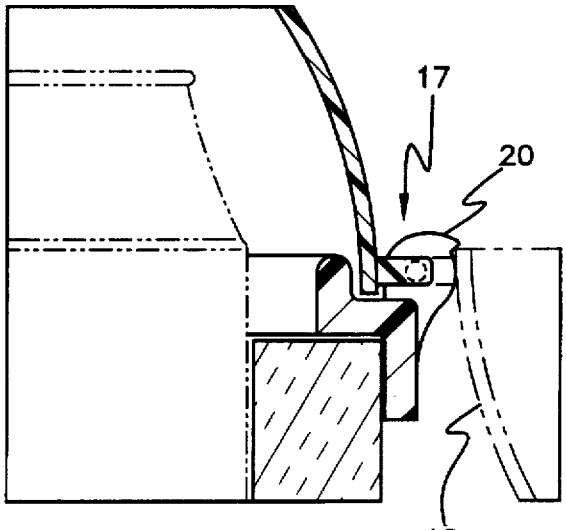
FIG. 5 is a perspective rear view of the dome shaped cover in both the open and locked positions.
Figure 6:
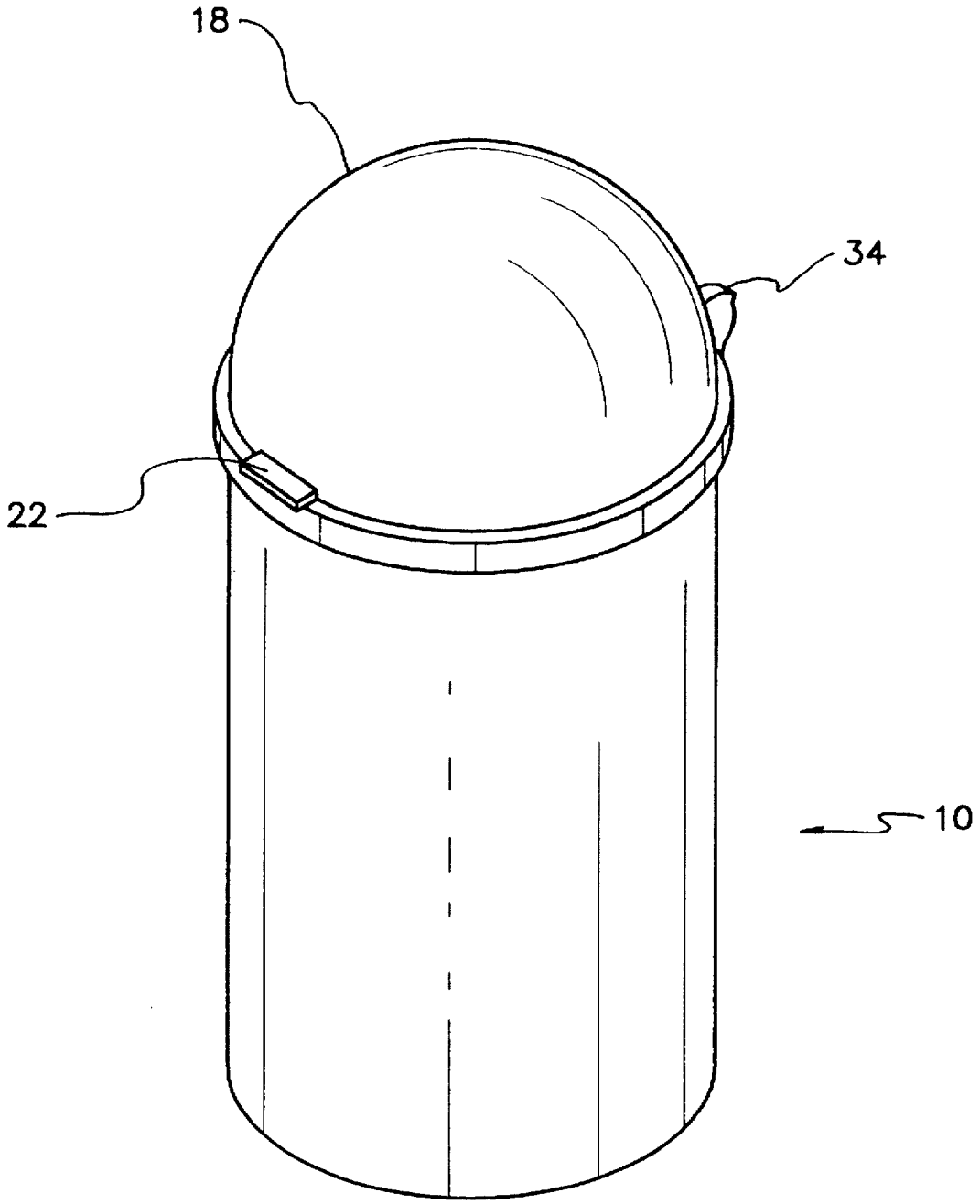
FIG. 6 is a perspective view of the container holder showing the annular collar, and the dome shaped cover in the closed position.

As further illustrated in FIGS. 1 and 4, the two-piece cover device includes an injection molded annular collar 16, of a suitable circumferential dimension to snugly fit around a typical beverage can 28. The annular collar 16 partially shown in FIG. 3, is further characterized by a recess 14 and a curved projection 12 over which the the lift tab 22 of cover 18, locks into the recess 14, in a closed mode. Correspondingly, there is a projection 34 on the cover adapted to frictionally engage with an aperture 17 (see FIG. 5) on the hinge of the annular collar 16, when it is pivoted to the fully open position. The engagement between the recess and the projection 34, which may be summarized as establishing an obstruction opposing return to the closed position, prevents the dome-shaped cover 18 from unduly pivoting back and forth. In the closed position the cover 18 establishes an air and watertight, sealing engagement with the annular collar.

A pair of upwardly extending hinge ears 20 connected by a rod, is integrally molded with the annular collar. The hinge enables the dome-shaped cover 18 to pivot from a closed position to an open position and vice-versa. This operation is performed by the lift tab 24, with which open and closure operations may be conveniently done.

The front elevation illustrated in FIG. 1 shows a beverage container 28 enclosed within the tubular, foam portion 26 of the beverage container holder 10. The buoyancy of the tubular foam portion 26 enables the beverage holder to float in an opened or closed position or even while encapsulating a beverage container.

A list of reference numerals for the present invention follows:

| | |
|---|---|
| 10 | beverage container holder |
| 12 | projected part of recess |
| 14 | recess |
| 16 | annular collar |
| 18 | cover |
| 20 | hinge ears |
| 22 | lift tab |
| 24 | shell lining |
| 26 | tubular foam shell |
| 28 | container |
| 30 | bottom end |
| 34 | rear projection of hinge |

While it will be apparent that the preferred embodiments of the invention herein disclosed is well calculated to fulfill the objects above stated, it will be appreciated that the invention is susceptible to modification, variation, and change without departing from the proper scope or fair meaning of the following claims.

I claim:

1. An insulated beverage holder comprising:

an external, cylindrical shell portion, said cylindrical shell portion constituted of a foam material sized for receiving a cylindrical beverage container, and having incorporated on it a two-piece cover device comprising an annular collar supported on said cylindrical shell portion;

a cover;

hinge means for pivotally connecting said cover to said annular cover, said hinge means comprising two upwardly extending ears and a rod connecting said two upwardly extending ears, wherein said cover may be pivoted on said hinge means to an open position exposing the beverage container, and to a closed position covering the beverage container;

first locking means to retain said cover in said closed position, comprising a horizontal lift tab extending outwardly from said cover, said annular collar forming a recess below said horizontal lift tab to receive said horizontal lift tab, and collar comprising a projection extending horizontally above said annular collar over said recess, wherein said horizontal lift tab slides over said projection to form a locking engagement with said recess, thus enabling said cover to be retained in said closed position; and second locking means to retain said cover in said open position.

2. The insulated beverage container holder as claimed in claim 1, wherein said cover is dome shaped.

3. The insulated beverage container as claimed in claim 2, wherein said two upwardly extending ears are attached to said annular collar and define a gap above said annular collar between said two upwardly extending ears, said second locking means comprises a resilient interference between a rear portion of said dome shaped cover and each of said ears, which when overcome spreads said ears enlarging said gap and which, upon further opening of said cover, allows said ears to resiliently return toward one another and to hold said cover in said open position.

4. An insulated beverage holder comprising:

an external, cylindrical shell portion, said cylindrical shell portion constituted of a foam material sized for receiving a cylindrical beverage container, and having incorporated on it a two-piece cover device comprising an annular collar supported on said cylindrical shell portion;

a cover;

hinge means for pivotally connecting said cover to said annular cover said hinge means comprising two upwardly extending ears attached to said collar and a rod rotatably engaging and spanning said two upwardly extending ears, wherein said cover may be pivoted on said rod to an open position exposing the beverage container, and to a closed position covering the beverage container;

first locking means for retaining said cover in said closed position; and second locking means to retain said cover in said open position, comprising a resilient interference between a rear portion of said cover and each of said ears, which when overcome deforms said ears and which, upon further opening of said cover, allows said ears to resiliently return to a normal position to retain said cover in said open position.

* * * * *